US008689688B2

(12) United States Patent
Nam et al.

(10) Patent No.: US 8,689,688 B2
(45) Date of Patent: Apr. 8, 2014

(54) PATTERN TRANSCRIPTION DEVICE AND METHOD OF FABRICATING CLICHÉ FOR THE SAME

(75) Inventors: Seung-Hee Nam, Suwon-si (KR); Nam-Kook Kim, Suwon-si (KR); Soon-Sung Yoo, Gunpo-si (KR); Youn-Gyong Chang, Annyang-si (KR)

(73) Assignee: LG Display Co., Ltd., Seoul (KR)

( * ) Notice: Subject to any disclaimer, the term of this patent is extended or adjusted under 35 U.S.C. 154(b) by 795 days.

(21) Appl. No.: 11/944,198

(22) Filed: Nov. 21, 2007

(65) Prior Publication Data

US 2008/0178756 A1 Jul. 31, 2008

(30) Foreign Application Priority Data

Jan. 31, 2007 (KR) ..... 10-2007-0010069

(51) Int. Cl.
*B41C 1/02* (2006.01)

(52) U.S. Cl.
CPC ..... *B41C 1/025* (2013.01)
USPC ..... 101/401.1; 101/217

(58) Field of Classification Search
None
See application file for complete search history.

(56) References Cited

U.S. PATENT DOCUMENTS

| | | | | |
|---|---|---|---|---|
| 6,300,042 | B1 * | 10/2001 | Mancini et al. | 430/325 |
| 2004/0123753 | A1 | 7/2004 | Yoo et al. | |
| 2006/0091106 | A1 * | 5/2006 | Kim | 216/41 |
| 2007/0048667 | A1 * | 3/2007 | Yoo et al. | 430/302 |

FOREIGN PATENT DOCUMENTS

JP 11-58921 A 3/1999

OTHER PUBLICATIONS

Office Action dated Dec. 24, 2009 issued by the Taiwanese Patent & Trademark Office for Taiwanese Patent Application No. 096144592.

* cited by examiner

*Primary Examiner* — Joshua D Zimmerman
(74) *Attorney, Agent, or Firm* — Brinks, Gilson & Lione

(57) ABSTRACT

A pattern transcription apparatus comprises a cliché including a concave portion, a convex portion and a printing stopper, the printing stopper formed on a bottom surface of the concave portion; and a blanket, on which a resist material layer is coated, rotatable on the cliché, wherein a surface energy density of the blanket is greater than a surface energy density of the printing stopper and is smaller than a surface energy of the cliché.

3 Claims, 12 Drawing Sheets

PATTERN TRANSCRIPTION DEVICE AND METHOD OF FABRICATING CLICHÉ FOR THE SAME

RELATED APPLICATIONS

The present application claims the benefit of Korean Patent Application No. 2007-0010069 filed in Korea on Jan. 31, 2007, which is hereby incorporated by reference.

BACKGROUND OF THE INVENTION

1. Field of the Invention

The present invention relates to a pattern transcription device, and more particularly, to a transcription device and a method of fabricating a cliché for the pattern transcription device being capable of forming a fine pattern without damages on the pattern.

2. Discussion of the Related Art

A flat panel display device, such as a liquid crystal display (LCD) device, includes a thin film transistor (TFT) as a switching element in each pixel. A fabricating process of the TFT requires many mask processes including a process of forming a photoresist pattern (PR). The PR pattern has a great effect on characteristics of the TFT. Characteristics of the TFT are the subject of significant research and development. Particularly, significant efforts have been devoted to improve characteristics of the TFT using a fine metal pattern.

Generally, a fabricating process of the PR pattern includes a step of forming a PR layer by coating a photosensitive PR material, a step of exposing the PR layer using a mask and a step of developing the exposed PR layer to form the PR pattern. However, since many process steps for fabricating the PR pattern, which are very complicated, are required to fabricate the TFT, production costs increase and production yield decreases.

To resolves these problems, a method of fabricating a resist pattern using a printing method is suggested. FIGS. 1A to 1D show a process of fabricating a resist pattern by a conventional reverse offset method. First, as shown in FIG. 1A, a resist material layer 32 is coated on an outer surface of a blanket 30. The blanket 30 covers along a circumference of a roller 31. The blanket 30 has a circumference being substantially the same as a length of a substrate, on which a resist pattern is to be formed.

Next, as shown in FIG. 1B, the blanket 30, on which the resist material layer 32 is coated, is rotated on a cliché 20 on a printing table 40. The cliché 20 includes a plurality of concave portions 22 and a plurality of convex portions 24 to resulting in an uneven surface. Each convex portion 24 is disposed between two adjacent concave portions 22. When the roller 31 is rotated on the cliché 20, a concave-counter pattern 34 is formed on the blanket 30 and a convex-counter pattern 36 is formed on the convex portion 24 because the resist material has a greater adhesive strength to the cliché 20 than the blanket 30. Namely, portions of the resist material layer 32 corresponding to the convex portion 24 are transferred on the convex portion 24, and the other portions of the resist material layer 32 corresponding to the concave portion 22 remains on the blanket 30, thereby forming the concave-counter pattern 34 on the blanket 30.

Next, as shown in FIG. 1C, the blanket 30 including the concave-counter pattern 34 contacts and is rotated on a process-object layer 11 disposed on a substrate 10. Then, the concave-counter pattern 34 is transferred on the process-object layer 11. By applying UV light to the concave-counter pattern 34 and hardening it, a resist pattern 38 is formed on the process-object layer 11, as shown in FIG. 1D.

Generally, the blanket 30 is formed of an elastic material, such as silicon or rubber. Accordingly, when the blanket 30 is rolled on the cliché 20, the blanket 30 is crushed and contacts a ground surface of the concave portion 22 of the cliché 20 because of an elastic property, as shown in FIG. 2A, such that the resist material is partially stuck to the ground surface of the concave portion 22 and the desired remained pattern 38 (of FIG. 1D) can not be obtained. Consequently, there are some undesired resist patterns on the process-object layer 11, as shown in FIG. 2B. These problems are easily caused as the resist pattern 38 is large in size.

To resolve these problems, it is possible to form the concave portions more deep so as not to contact the blanket with the ground surface of the concave portions. However, when the concave portion has a greater depth, there are losses on a critical dimension. The concave portion is formed by a wet-etching, which has isotropic properties, using an etchant. The greater depth the concave portion has, the greater width the concave portion has. Namely, the width is proportional to the depth. It is difficult to form a fine pattern with a great width.

SUMMARY OF THE DISCLOSURE

A pattern transcription apparatus comprises a cliché including a concave portion, a convex portion and a printing stopper. The printing stopper is formed on a bottom surface of the concave portion. The apparatus also includes a blanket, on which a resist material layer is coated, rotatable on the cliché, wherein a surface energy density of the blanket is greater than a surface energy density of the printing stopper and is smaller than a surface energy of the cliché.

In another aspect of the present disclosure, a pattern transcription apparatus comprises a cliché including a concave portion and a convex portion; and a blanket, on which a resist material layer is coated, rotatable on the cliché and including first, second and third layers. The first layer contacts the resist material layer, and the second layer is disposed between the first and third layers, wherein a hardness of the first layer is lower than a hardness of the second layer and greater than a hardness of the third layer.

In another aspect of the present invention, a pattern transcription apparatus comprises a cliché including a concave portion and a convex portion; and a blanket, on which a resist material layer is coated, rotatable on the cliché and including first, second and third layers. The first layer contacts the resist material layer, and the second layer is disposed between the first and third layers, wherein the third layer has a greater thickness than both the first and second layers.

In another aspect of the present invention, a method of fabricating a cliché for a pattern transcription apparatus comprises forming a metal pattern on a substrate; etching the substrate using the metal pattern as an etching mask to form a concave portion and a convex portion; and forming a printing stopper on a bottom surface of the concave portion, wherein the printing stopper has a surface energy density smaller than the substrate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE EMBODIMENTS

Reference will now be made in detail to the embodiments, examples of which are illustrated in the accompanying drawings.

Figure 1A:
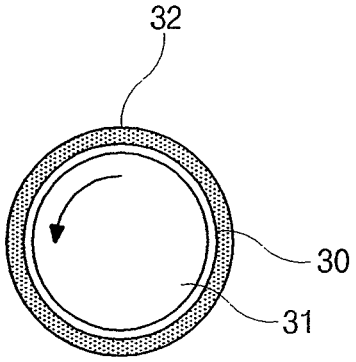
FIG. 1A RELATED ART
FIGS. 1A to 1D show a process of fabricating a resist pattern by a conventional reverse offset method.
Figure 1B:
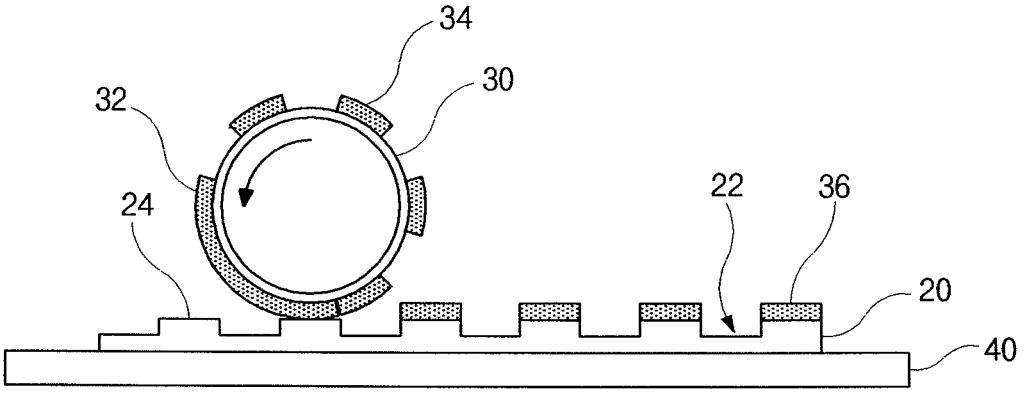
FIG. 1B RELATED ART
Figure 1C:
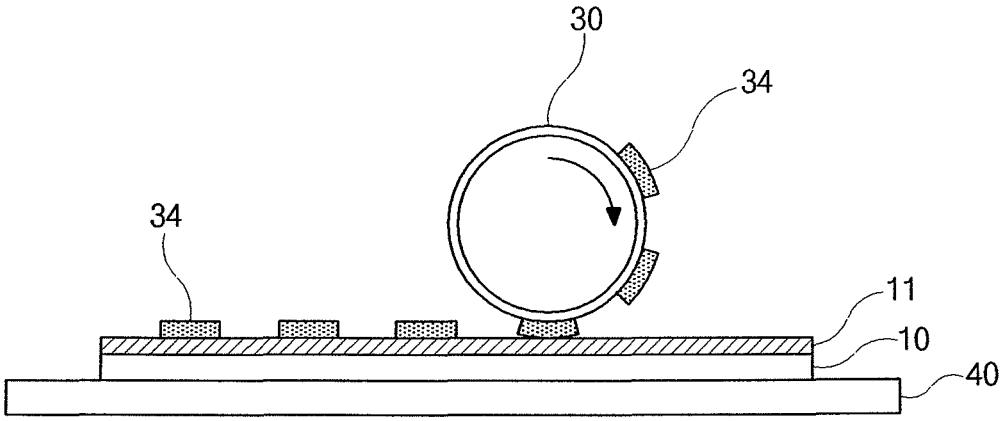
FIG. 1C RELATED ART
Figure 1D:
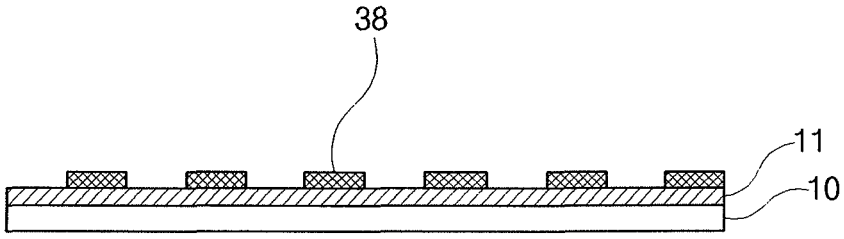
FIG. 1D RELATED ART
Figure 2A:
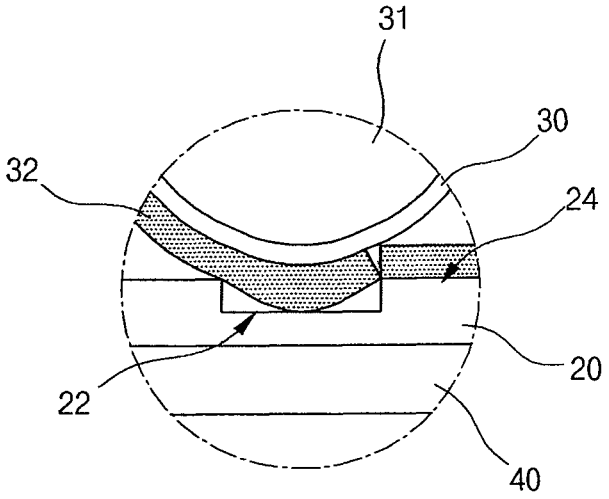
FIG. 2A RELATED ART
FIG. 2A is an enlarging view showing a concave portion contacting a resist material.
Figure 2B:
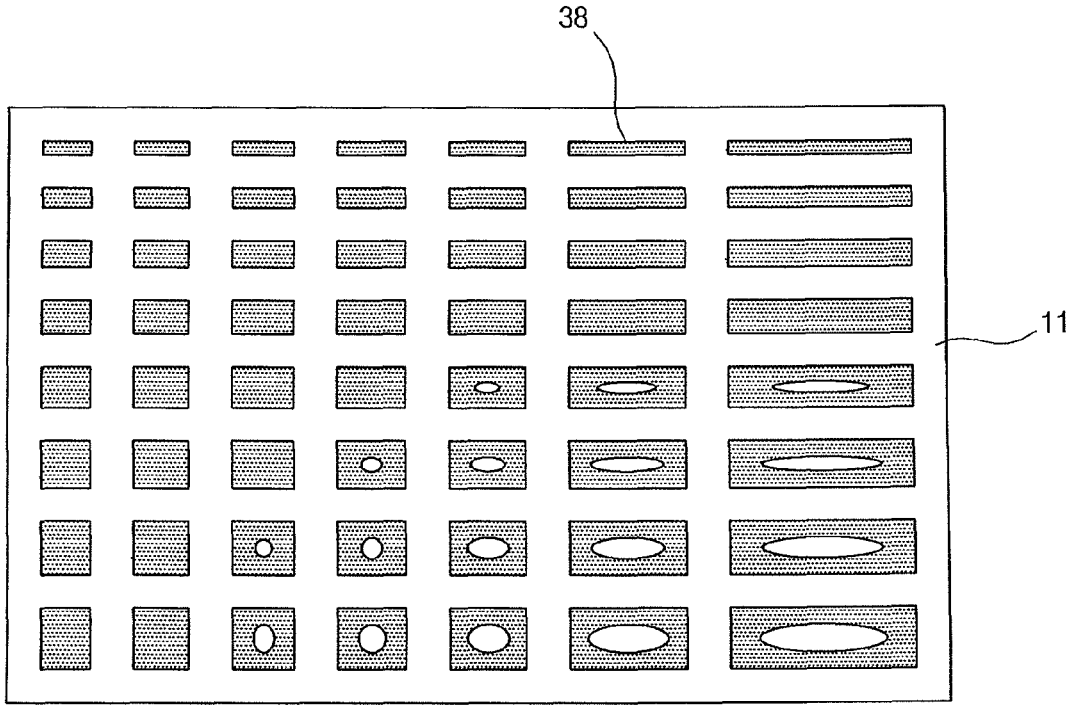
FIG. 2B RELATED ART
FIG. 2B is a plane perspective view showing a process-objected layer having an undesired resist pattern.
Figure 3A:
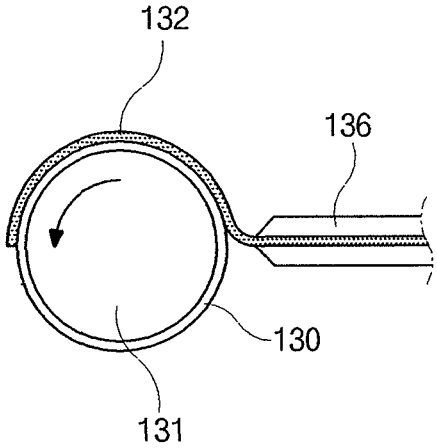
FIGS. 3A to 3D show a process of fabricating a resist pattern by a reverse offset method according to an embodiment of the present invention.

FIGS. 3A to 3D show a process of fabricating a resist pattern by a reverse offset method according to an embodiment of the present disclosure. First, as shown in FIG. 3A, a blanket 130 covers along a circumference of a roller 131, and a resist material layer 132 is coated on an outer surface of the blanket 130. When the blanket 130 with roller 131 is rotated, a resist supplier 136 supplies a resist material to the outer surface of the blanket 130 such that the resist material layer 132 is uniformly formed on the outer surface of the blanket 130.

Figure 3B:
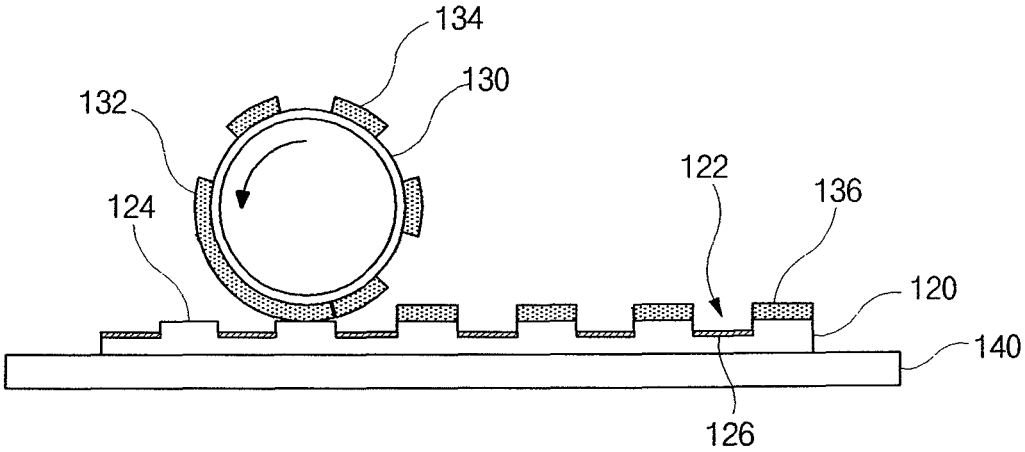

Next, as shown in FIG. 3B, the blanket 130, on which the resist material layer 132 is coated, contacts and is rotated on a cliché 120 formed on a printing table 140. The cliché 120 includes a plurality of concave portions 122 and a plurality of convex portions 124. Namely, the cliché 120 has an uneven surface. Each convex portion 124 is disposed between two concave portions 122. Each of the concave portions 122 corresponds to a pattern that is desired to be formed on a substrate. In addition, a printing stopper 126 is formed in each concave portion 122 to prevent the resist material being printed on the concave portions 122. The printing stopper 126 is formed of a material having a surface energy density smaller than that of a blanket 130. For example, the printing stopper 126 is formed of teflon. A material of the blanket 130 has a surface energy density with a range between 20 mJ/cm$^2$ and 23 mJ/cm$^2$, while a material of printing stopper 126, such as teflon, has a surface energy density with a range between 13 mJ/cm$^2$ and 18 mJ/cm$^2$. In brief, a material of the printing stopper 126 has a surface energy density smaller than a material of the blanket 130. This means that the resist material is much stickier with respect to the blanket 130 than the printing stopper 126. Namely, the resist material has a first adhesive strength to the blanket 130 and a second adhesive strength, smaller than the first adhesive strength, to the printing stopper 126. Moreover, the resist material has a third adhesive strength to the cliché 120. The third adhesive strength is greater than the first and second adhesive strengths. Namely, a surface energy density of the blanket 130 is greater than that of the printing stopper 126 and smaller than that of the cliché 120. Accordingly, when the blanket 130 contacts and is rotated on the cliché 120, a convex-counter pattern 136 is formed on the convex pattern 124 and a concave-counter pattern 134 is formed on the blanket 130. Namely, since the resist material layer 132 is much stickier to the cliché 120 than the blanket 130, the resist material layer 132 on the blanket 130 is transferred to the convex portions 124 to form the convex-counter pattern 136 on the convex portion 124 when the resist material layer 132 contacts the cliché 120. However, since the resist material layer 132 is much stickier to the blanket 130 than the printing stopper 126, the resist material layer 132 on the blanket 130 is never transferred to the printing stopper 126 even if the resist material layer 132 contacts the cliché 120. Accordingly, the concave-counter pattern 134 is formed on the blanket 130.

Figure 3C:
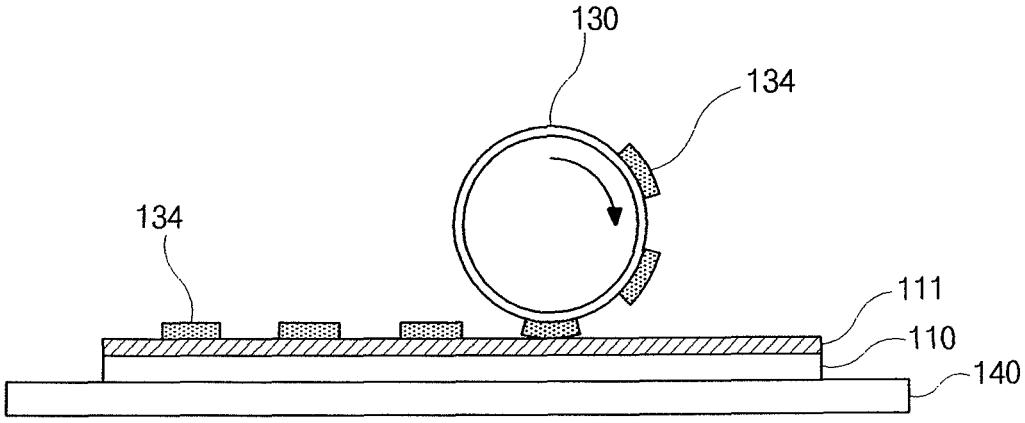
Figure 3D:
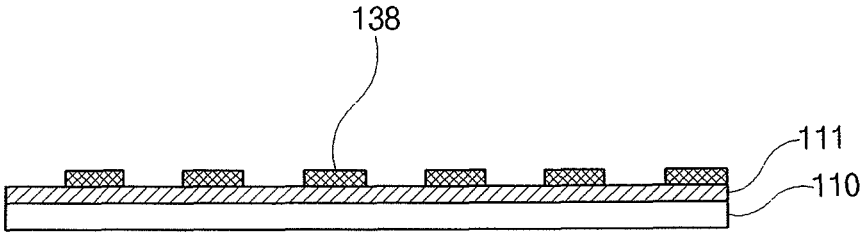

Next, as shown in FIG. 3C, the blanket 130 having a plurality of concave-counter patterns 134 contacts and rotated on a process-object layer 111 to from the plurality of concave-counter patterns 134 on the process-object layer 111 on a substrate 110. Since the resist material is much stickier to the process-object layer 111 than the blanket 130, the concave-counter patterns 134 on the blanket 130 are transferred onto the process-object layer 111 when the concave-counter patterns 134 contacts the process-object layer 111. Since a circumference of the blanket 130 is substantially the same as a length of the substrate 110, the plurality of concave-counter patterns 134 on the blanket 130 are wholly transferred onto the process-object layer 111 by a single rotation.

Next, the concave-counter patterns 134 on the process-object layer 111 is irradiated by UV light and hardened to form resist patterns 138 on the process-object layer 111.

The process-object layer 111 may be a metal layer, from which metal patterns, e.g., a gate electrode, a source electrode and a data electrode of a thin film transistor (TFT), are formed, and an insulating layer including one of silicon oxide and silicon nitride. The process-object layer 111 may be etched using the resist patterns 138 as an etching mask to form the metal patterns or a contact hole in the insulating layer.

As explained above, since the printing stopper 126, which is less sticky to the resist material than the blanket 130, is formed on the concave portions 122 of the clicke 120, the resist material is never transferred to the concave portions 122 even if the resist material on the blanket 130 contacting printing stopper 126. Accordingly, a desired concave-counter pattern 134 is formed on the blanket 130 without a sticky portion on the printing stopper 126. The problem in the related art is improved.

Figure 4A:
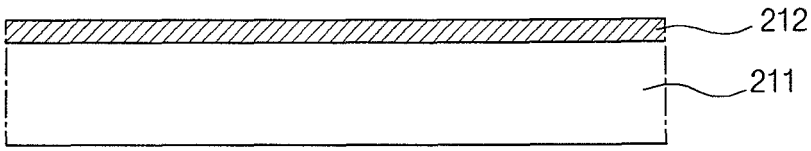
FIGS. 4A to 4F are cross-sectional views showing a process of fabricating a cliché according to an embodiment of the present disclosure.
Figure 4B:
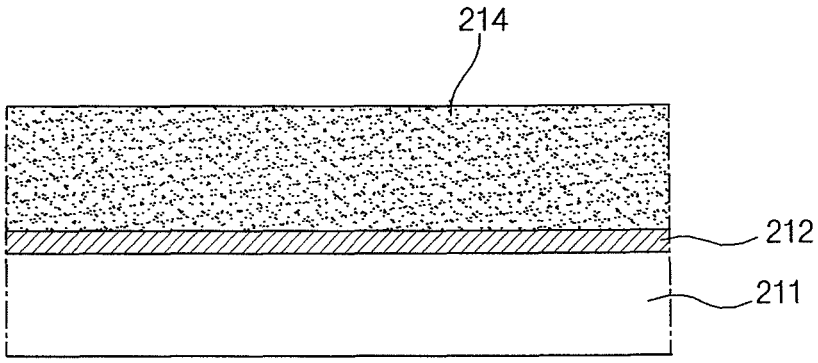
Figure 4C:
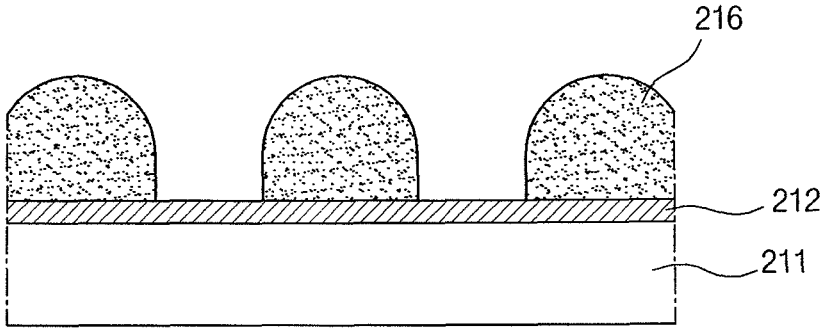

FIGS. 4A to 4F are cross-sectional views showing a process of fabricating a cliché according to an embodiment of the present disclosure. As shown in FIG. 4A, a metal layer 212 is formed on a substrate 211 by depositing at least one metallic material selected from a metal group including molybdenum (Mo), chromium (Cr) and nickel (Ni). Next, as shown in FIG. 4B, a photosensitive material layer 214 is formed on the metal layer 212 by depositing photoresist. Next, a mask (not shown) having a transmitting portion and a blocking portion is disposed over the photosensitive material layer 214. The transmitting portion has a relatively high transmittance so that light through the transmitting portion can completely change the photosensitive material layer 214 chemically. The blocking portion shields light completely. Namely, a transmittance of the transmitting portion is greater than that of the blocking portion. The blocking portion of the mask corresponds to a position that is desired to form a convex portion, and transmitting portion of the mask corresponds to a position that is desired to form a concave portion. Then, the photosensitive material layer 214 is exposed through the mask (not shown) and developed to form a photosensitive material pattern 216, as shown in FIG. 4C.

Figure 4D:
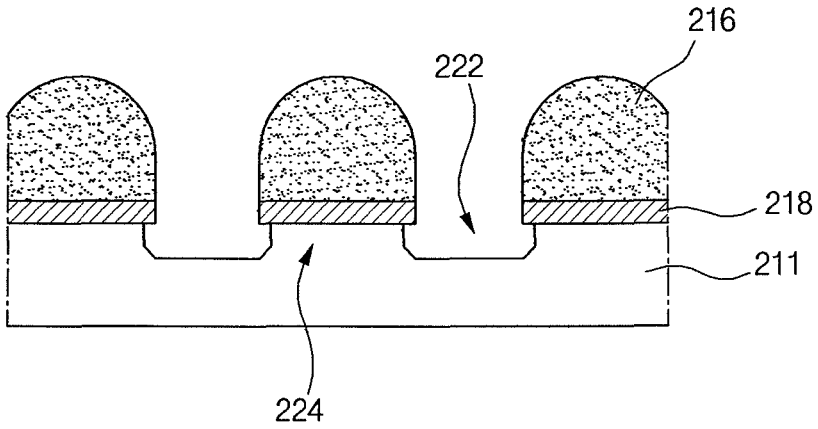
Figure 4E:
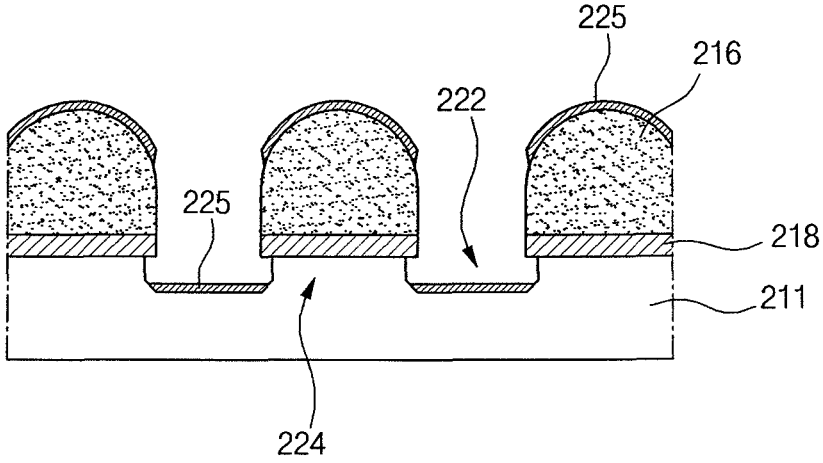
Figure 4F:
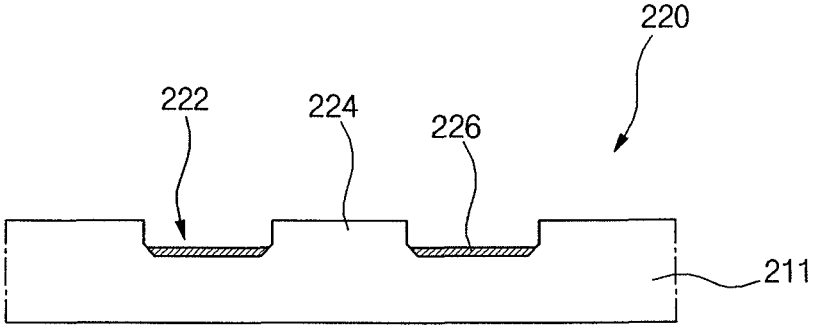

Next, as shown in FIG. 4D, the metal layer 212 (of FIG. 4C) exposed through the photosensitive material patterns 216 is etched using the photosensitive material pattern 216 as an etching mask to form a metal pattern 218. The metal pattern 218 corresponds to the photosensitive material pattern 216. And then, the substrate 211 exposed through the metal patterns 218 is etched using the metal pattern 218 as an etching mask to form a plurality of concave portions 222. Moreover, since the substrate 211 is etched to form the plurality of concave portions 222, other portions of the substrate 211 protrude. The protruding portions are defined as a plurality of convex portions 224. Next, as shown in FIG. 4E, a low surface energy density material layer 225 is formed on the substrate 211 including photosensitive material pattern 216. The low surface energy density material layer 225 is formed on both the photosensitive material pattern 216 and a ground surface of the concave portions 222. The low surface energy density material layer 225 may include teflon. Next, the photosensitive material pattern 216 and the metal pattern 218 are removed from the substrate 211. The low surface energy density material layer 225 on the ground surface of the concave portions 222 is defined as a printing stopper 226, as shown in FIG. 4F. The substrate 211 including the plurality of concave portions 222, the plurality of convex portions 224 and the printing stopper 126 is called a cliché 220.

On other hand, a cliché may be formed without a metal layer 212 (of FIG. 4A) to decrease a process time and increase production yield. However, since a photosensitive material layer 214 (of FIG. 4B) has a poor adhesive strength to the substrate 211 (of FIG. 4A) of glass, it is difficult to obtain a fine pattern without the metal layer 212 (of FIG. 4A).

Figure 5A:
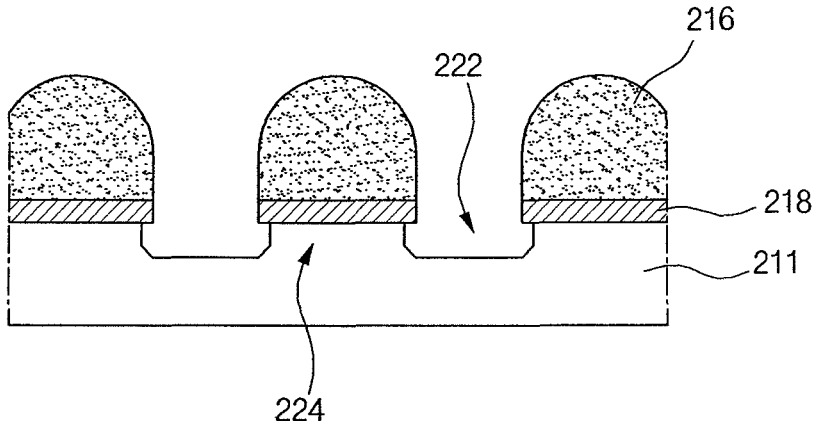
FIGS. 5A to 5E are cross-sectional views showing a process of fabricating a cliché according to another embodiment of the present disclosure.
Figure 5B:
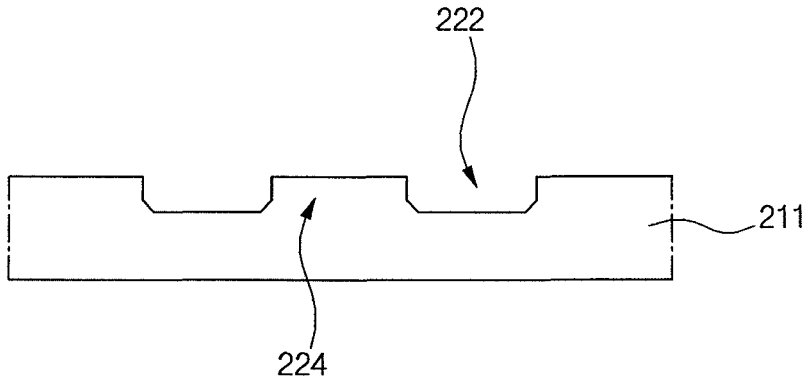

FIGS. 5A to 5E are cross-sectional views showing a process of fabricating a cliché according to another embodiment of the present disclosure. As shown in FIG. 5A, a metal pattern 218 and a photosensitive material pattern 216 are formed on a substrate 211. The substrate 211 is etched using the metal pattern 218 as an etching mask to form a plurality of concave portions 222 and a plurality of convex portions 224. The metal pattern 218 and the photosensitive material pattern 216 are formed through processes shown in FIGS. 4A to 4D. Next, as shown in FIG. 5B, the metal pattern 218 and the photosensitive material pattern 216 are removed.

Figure 5C:
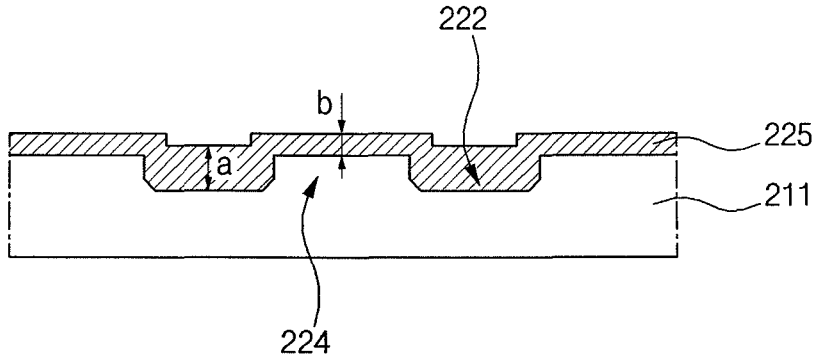
Figure 5D:
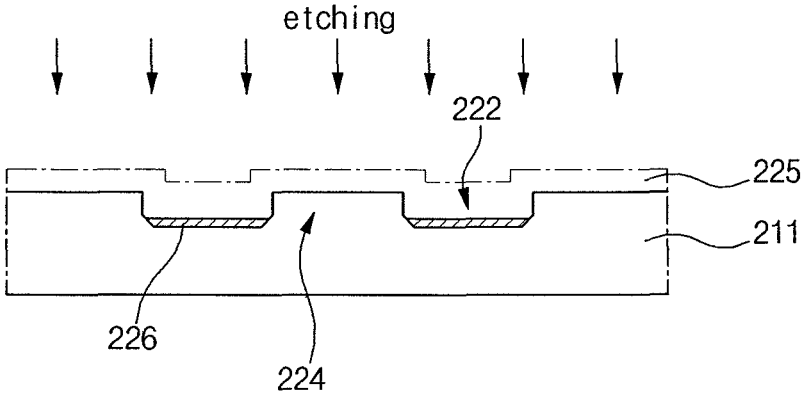
Figure 5E:
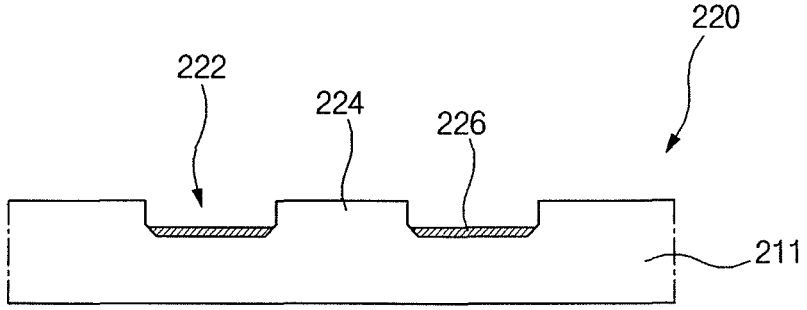

Next, as shown in FIG. 5C, a low surface energy density material layer 225 is formed on the substrate 211 including the plurality concave portions 222 and the plurality of convex portions 224. The low surface energy density material layer 225 may include teflon. The low surface energy density material layer 225 is formed on both the concave portions 222 and the convex portions 224. Since the substrate 211 includes the plurality concave portions 222 and the plurality of convex portions 224, the low surface energy density material layer 225 has different thickness. The low surface energy density material layer 225 corresponding to the concave portions 222 has a first thickness "a" greater than a second thickness "b" of the low surface energy density material layer 225 corresponding to the convex portions 224. ("a">"b") Next, as shown in FIG. 5D, the low surface energy density material layer 225 is partially etched to expose an upper surface of the convex patterns 224. Namely, the low surface energy density material layer 225 is etched by the second thickness "b" such that a printing stopper 226 is formed on a ground surface of the concave portion 224. The printing stopper 226 may have a thickness of "a-b". As a result, a cliché 220 including the substrate 211 having the plurality of concave portions 222 and the plurality of convex portions 224 and the printing stopper 226 on the ground surface of the concave portions 222 is fabricated, as shown in FIG. 5E.

Figure 6:
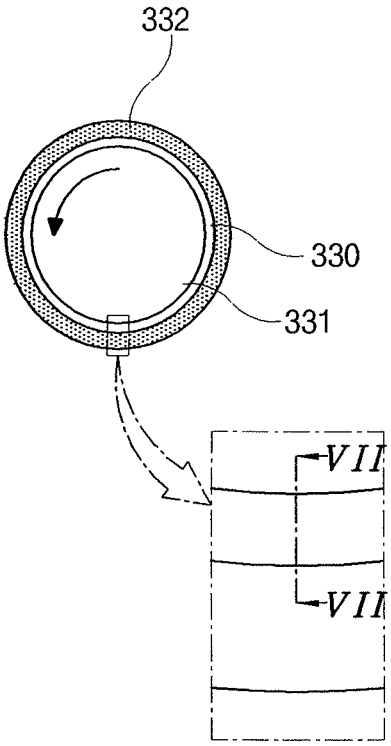
FIG. 6 is a schematic cross-sectional view of a blanket with a roller according to an embodiment of the present invention.
Figure 7:
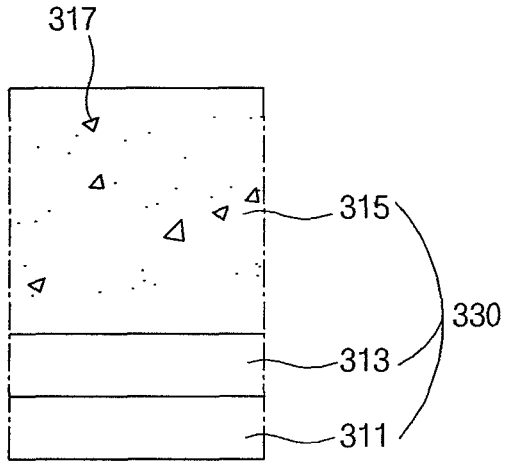
FIG. 7 is a cross-sectional view taken along the line VII-VII of FIG. 6.

FIG. 6 is a schematic cross-sectional view of a blanket with a roller according to an embodiment of the present disclosure, and FIG. 7 is a cross-sectional view taken along the line VII-VII of FIG. 6. As shown in FIG. 6, a blanket 330 covers along a circumference of a roller 331, and a resist material layer 332 is coated on an outer surface of the blanket 330. The blanket 330 includes a rubber layer 311, a support layer 313 and a cushion layer 315, as shown in FIG. 7. The rubber layer 311 contacts the resist material layer 332 (of FIG. 6), and the support layer 313 is disposed between the rubber layer 311 and the cushion layer 315. The rubber layer 311 is formed of an elastic material, such as silicon and rubber. The rubber layer 311 may be polydimethylsiloxane. The resist material layer 332 is coated on the rubber layer 311. The rubber layer 311 has a desired hardness not to be crushed when the blanket 330 contacts and is rotated on the cliché 120 (of FIG. 3B). The support layer 313 is formed of one of a plastic material, such as polyethylene and polyethyleneterephthalate (PET), and a metallic material. Since the support layer 313 functions as to sustain the rubber layer 311, the support layer 313 has a relative high hardness. Moreover, the support layer 313 has a poor ductile property. The cushion layer 315 is formed of an elastic material including a foamy material 317 and one of silicon and rubber. The cushion layer 315 functions as to absorb an impact against the blanket 330 during contacting the process-object layer 111 (of FIG. 3C) or the cliché 120 (of FIG. 3B). The cushion layer 315 has a relative low hardness to absorb the impact. As a result, a hardness of the rubber layer 311 is greater than that of the cushion layer 315 and less than that of the support layer 313.

On the other hand, when the blanket 330 is fast rotated on the process-object layer 111 (of FIG. 3C) or the cliché 120 (of FIG. 3B), the impact is not transferred onto the cushion layer 315, but rubber layer 311 absorbs the impact. As a result, the rubber layer 311 becomes crushed. To avoid this problem, the cushion layer 315 has a greater thickness than both the rubber layer 311 and the support layer 313.

In the present disclosure, since the rubber layer 311 has a hardness greater than the cushion layer 315, which has a greater thickness than the rubber layer 311 and the support layer 313, and less than the support layer 313, the blanket 330 is not crushed and does not contact the ground surface of the concave portion 122 (of FIG. 3B) in the cliché 120 (of FIG. 3B) when the blanket contacts and is rotated on the cliché.

Accordingly, desired resist patterns are obtained.

It will be apparent to those skilled in the art that various modifications and variations can be made in the organic electroluminescent device and fabricating method thereof of the present invention without departing from the spirit or scope of the invention. Thus, it is intended that the present invention cover the modifications and variations of this invention provided they come within the scope of the appended claims and their equivalents.

What is claimed is:

1. A method of fabricating a cliché for a pattern transcription apparatus, comprising:

forming a metal pattern on a substrate;

forming a photosensitive material pattern on the metal pattern;

etching the substrate using the metal pattern and the photosensitive material pattern as an etching mask to form a concave portion having a desired depth and a convex portion without etching the metal pattern, wherein the substrate has a first thickness in the concave portion and a second thickness, which is larger than the first thickness, in the convex portion;

removing the photosensitive material pattern and the metal pattern from the substrate including the concave portion and the convex portion;

forming a low surface energy material layer on the substrate including the concave portion and the convex portion, the low surface energy material layer having a third thickness in the concave portion and a fourth thickness, which is smaller than the third thickness, in the convex portion; and removing the low surface energy material layer in the convex portion and the concave portion by the fourth thickness to expose the substrate in the convex portion and to form a printing stopper in the concave portion, thereby forming the cliché having the concave portion with the desired depth and with the printing stopper in the concave portion, wherein the printing stopper has a surface energy density smaller than the substrate.

2. The method according to claim 1, wherein the printing stopper has a height from a bottom surface of the substrate.

3. The method according to claim 1, wherein the step of forming the metal pattern comprises:

forming a metal layer on the substrate and a photosensitive material layer on the metal layer;

exposing the photosensitive material layer using a mask;

developing the photosensitive material layer to form the photosensitive material pattern; and etching the metal layer using the photosensitive material pattern as an etching mask to form the metal pattern on the substrate.

* * * * *